US005476365A

United States Patent [19]

Kobayashi

[11] Patent Number: 5,476,365

[45] Date of Patent: Dec. 19, 1995

[54] CENTRIFUGAL BLOWER WHEEL WITH FORWARD CURVED MULTI-BLADES

[76] Inventor: Takao Kobayashi, No. 15-16, Momohamacho, Hiratsuka-shi, Kanagawa-ken, Japan

[21] Appl. No.: 310,770

[22] Filed: Sep. 27, 1994

[30] Foreign Application Priority Data

Sep. 28, 1993 [JP] Japan ..... 5-263122

[51] Int. Cl.[6] ..... F04D 29/28; F04D 29/30

[52] U.S. Cl. ..... 416/178; 416/184; 416/187; 416/229 R; 416/241 A; 416/DIG. 3

[58] Field of Search ..... 416/178, 184, 416/187, 220 R, 241 A, DIG. 3, 199; 29/889.21, 889.4

[56] References Cited

U.S. PATENT DOCUMENTS

| | | | |
|---|---|---|---|
| 2,852,182 | 9/1958 | Wilken . | |
| 3,041,050 | 6/1962 | Nelson et al. | 416/178 |
| 3,130,899 | 4/1964 | Braun et al. | 416/187 |
| 3,138,319 | 6/1964 | Delaney et al. . | |
| 3,423,012 | 1/1969 | Baker . | |
| 3,450,337 | 6/1969 | Jolette | 29/889.4 |
| 4,329,118 | 5/1982 | Ranz . | |
| 4,483,268 | 11/1984 | Pichl | 416/241 A |
| 4,515,527 | 5/1985 | Baker . | |

FOREIGN PATENT DOCUMENTS

| | | |
|---|---|---|
| 64-41697 | 3/1983 | Japan . |

*Primary Examiner*—Edward K. Look
*Assistant Examiner*—Christopher Verdier
*Attorney, Agent, or Firm*—Parkhurst, Wendel & Rossi

[57] ABSTRACT

A centrifugal blower wheel is provided with forward-curved multi-blades comprising a pair of end rings, a plurality of blades and a disk. By separating the blades into "vane members" which assume the function of a fluid device and "vane attachment members" which assume the function of a high speed rotating device, there is a greater degree of freedom of design, so optimum materials and shapes can be assigned to these different functions. The end rings, vane attachment members and disk are therefore constructed of metal and provided with beads so as to give a highly rigid structure, while the vane members are constructed of non-metal. This makes it possible to provide a blower wheel which is more lightweight and quieter in operation than a conventional blower wheel.

6 Claims, 5 Drawing Sheets

CENTRIFUGAL BLOWER WHEEL WITH FORWARD CURVED MULTI-BLADES

BACKGROUND OF THE INVENTION

1. Field of the Invention

This invention relates to the structure of a double inlet wheel of a centrifugal blower with forward curved blades used in devices such as air conditioners, ventilators, exhaust systems and instrument cooling units (referred to hereafter as wheel), and to the method of manufacturing this wheel. This wheel has the advantages of greater lightweightness, quieter operation and higher efficiency. This application is described insofar as it applies to the case of a double inlet wheel, but it may be applied also to the case of a single inlet wheel.

2. Prior Art

Conventional wheels may be broadly divided into three types according to their construction and the materials of which they are made. These types will hereinafter be referred to as type A wheel, type B wheel and type C wheel. The type A wheel consists of a large number of individual blades, a pair of end rings and a center disk. An example of this type is disclosed in U.S. Pat. No. 2,852, 182. The type B wheel comprises a continuous strip blade which forms a cylindrical body, a pair of end rings, and a center disk. An example of this type is disclosed in U.S. Pat. No. 3,335,482. In both type A and type B wheels, all parts are made of metal plates, the cross-sectional form of the blades being that of a curved flat plate rather than an airfoil shape. The operation of the wheel is therefore noisy, and it is not very efficient. In the type B wheel, the blades are fashioned from a single metal strip, hence there are limitations on the number of blades and their arc length which makes it difficult to obtain the desired air volume and pressure. However, as the construction involves only two parts, productivity is high and operating precision after assembly is high. Type C is made in a one-piece construction by injection molding of a plastic material, the cross-sectional form of the blades being that of an airfoil. No previous applications have been found in the literature regarding this type. Of the three types, type C is the quietest in operation and it has the highest efficiency, but as the strength of the material is lower than that of metal, it is not possible to manufacture a wheel of large diameter. It is also subject to creep and deformation with temperature rise, so the places in which it can be operated are limited.

All three types have their respective advantages and disadvantages, hence there was no blower which was completely satisfactory in all points. The type of wheel was therefore chosen depending on the place where it was to be operated and on the running conditions.

In recent years, more blowers are coming to be installed near by living spaces and working spaces, and a need has emerged for higher efficiency with less noise. At the same time there is a need for greater compactness, which means the blower must be operated at even higher speeds. Blower wheels therefore have to withstand high speeds, be rigid and have a good dynamic balance. In particular, in the case of air conditioning or ventilation systems, more units are being installed in or suspended from ceilings so as to enable more effective use of floor space. This creates a greater need for blowers to be more lightweight and quieter in operation, however these requirements cannot be met by the aforementioned conventional wheel structures and manufacturing methods.

SUMMARY OF THE INVENTION

It is therefore an object of this invention to provide a blower wheel which is more lightweight than conventional blowers, which is quiet in operation, and which is highly efficient.

It is a further object of this invention to provide a structure and engineering technique for efficiently producing a blower wheel of high precision and high rigidity.

It is a still further object of this invention to provide a blower wheel having the advantages of a plastic blower with a large diameter which could not be attained by conventional technology.

A blower wheel is normally required to have two different functions, namely, that of a fluid device (high blowing efficiency coupled with silent operation), and that of high speed rotor (high rigidity and good dynamic balance). These functions are mutually conflicting.

In order to increase rigidity as a rotor, it is expedient to provide beads on the surface of the blades, but as this causes fluid to separate away at the blade surface, the fluid function of the wheel is considerably impaired. Further, plastic is the most suitable material from the viewpoint of reducing the noise of the wheel as a fluid device, but as this material has inadequate strength, the strength and rigidity of the wheel as a rotor suffer. Attempts were made to design conventional wheels to satisfy these two conflicting requirements at the same time, but they were not successful.

According to this invention, these two functions, namely that of a vane as a fluid device, and that of a rotor as a rotating device, are separately analyzed in depth, and then integrated into a novel design concept which gives an ideal blower wheel combination.

The design concept of this invention will now be described.

1. First, the rotor is designed.

(1) Type B, which has the best properties and has the highest productivity of the aforesaid three types, is chosen for the basic structure of the rotor.

(2) Each blade is separated into a vane member which is a fluid device, and a vane attachment member which is a rotating device, and these members are considered separately. These vane attachment members which are formed from a continuous metal plate that has been cut to a convenient length, are provided with "beads" which were disallowed in the case of a fluid device. Next, this plate is rolled into a cylinder, and the ends are brought together and then welded so as to form a cylindrical shell. The two ends of this cylindrical shell are curled over so as to form a pair of end rings. This gives a stronger cylindrical shell comprising the vane attachment members whereof the two ends are attached to the pair of end rings. By inserting a disk into the center of this cylindrical shell and fixing the vane attachment members or vane members by adhering or caulking, an ideal blower is obtained. The material of this "wheel" may be a metal wheel plate (e.g. steel, stainless steel, aluminum, titanium, etc.) chosen according to the operating conditions of the blower.

2. Once the vane attachment members have the rotating device function of the rotor, the fluid device function of the vane members may then be developed. This makes it possible to use materials which were conventionally optimal for a fluid device, but were unsuitable for a rotating device on account of inadequate strength, insufficient rigidity and creep properties. Designers can therefore now design vane members of optimal shape using optimal materials (e.g. plastics or ceramics) for the vane conditions.

(1) Optimal non-metals for the vane members are chosen depending on the operating conditions of the blower, for example plastics and ceramics.

(2) The vane members are molded by production design techniques according to wheel production volume, for example extrusion molding, injection molding or compression molding.

(3) A blade is obtained by joining a vane member to a vane attachment member.

(4) As the vane attachment members which are constructed of metal and the vane members which are constructed of non-metal have different thermal expansion coefficients, peeling easily occurs. Small holes are therefore pierced at several positions in the vane attachment members, and the vane members are completely joined or welded together through these holes so as to prevent peeling.

3. By joining an optimized rotor to optimized vanes in this way, an optimized blower wheel is obtained.

4. In the aforesaid description, the structure is a single metal plate wherein a pair of end rings are connected to a plurality of vane attachment members, but the structure may also be formed from three separate metal plates.

5. In the aforesaid description, the wheel is a double inlet type, but it may also be a single inlet type.

DESCRIPTION OF THE PREFERRED EMBODIMENTS

Embodiment 1

Figure 1:
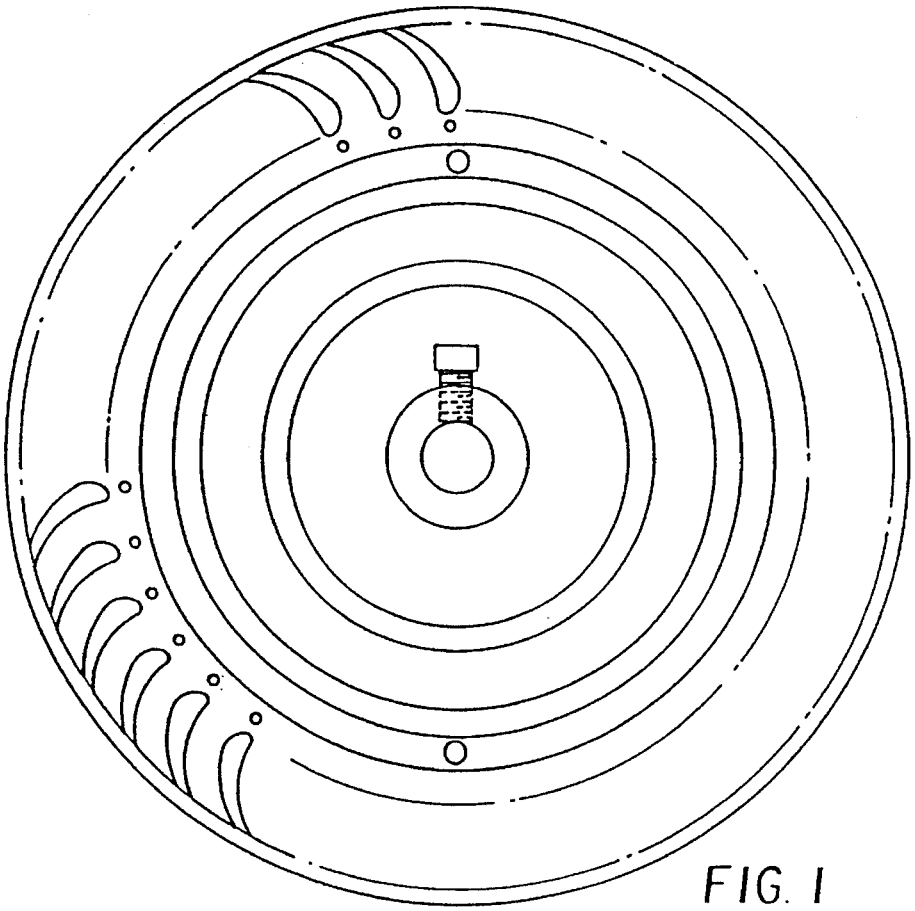
FIG. 1 is an end view of a blower wheel showing one embodiment of this invention.
Figure 2:
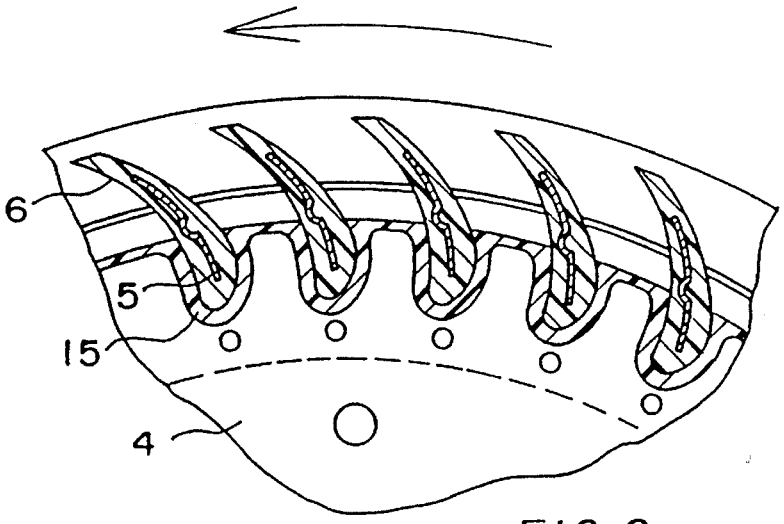
FIG. 2 is an enlarged cross-section of part of same.
Figure 3:
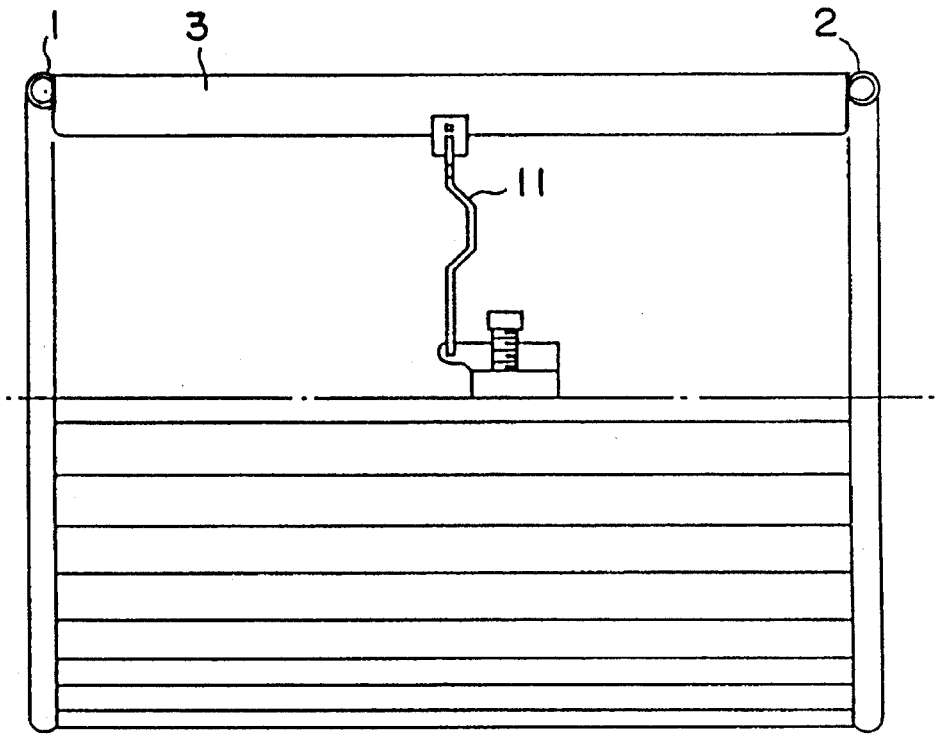
FIG. 3 is a partially sectional side view of the blower wheel showing one embodiment of this invention.
Figure 4:
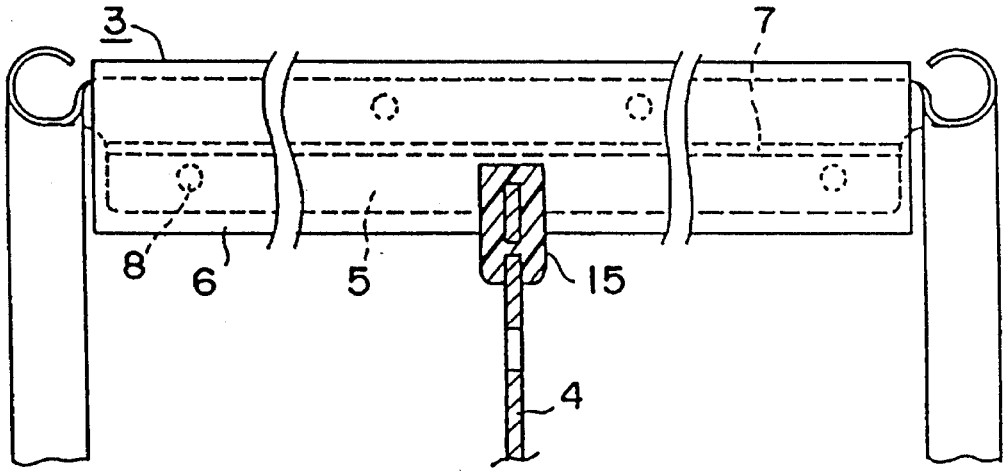
FIG. 4 is an enlarged view of same.
Figure 5:
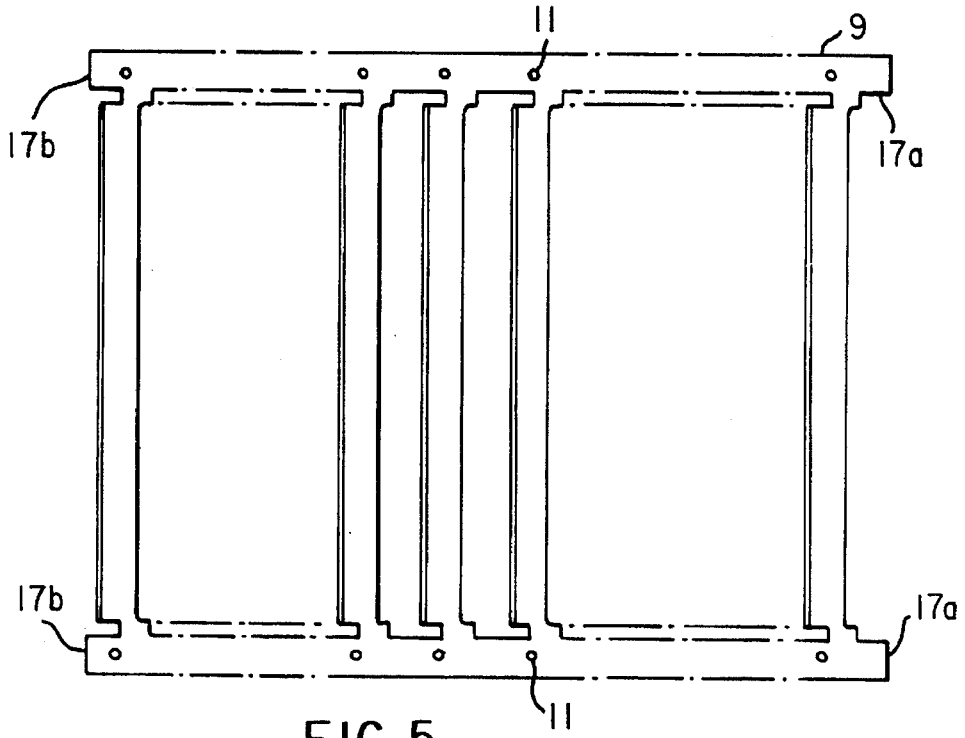
FIG. 5 is a plan view of a stamped metal sheet 9.
Figure 6:
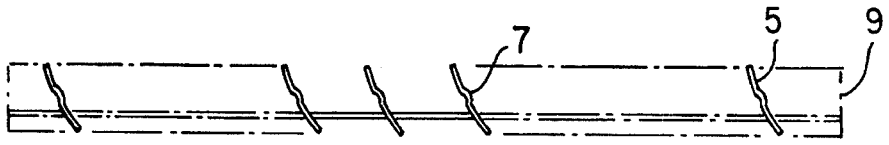
FIG. 6 is a front view of a middle section of same.
Figure 7:
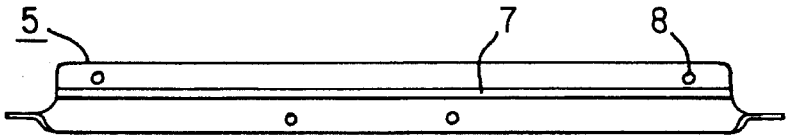
FIG. 7 is a lateral view of same.
Figure 8:
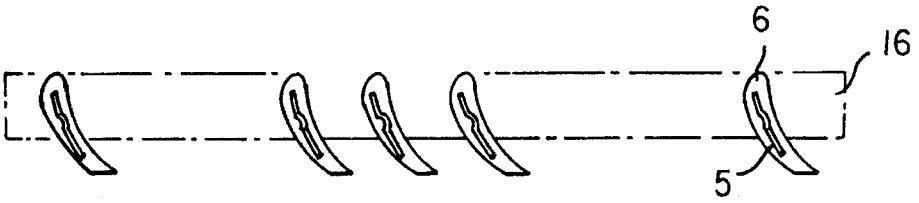
FIG. 8 is a lateral view of same wherein vane attachment members 5 of the stamped metal sheet 9 have been provided with vane members 6.
Figure 9:
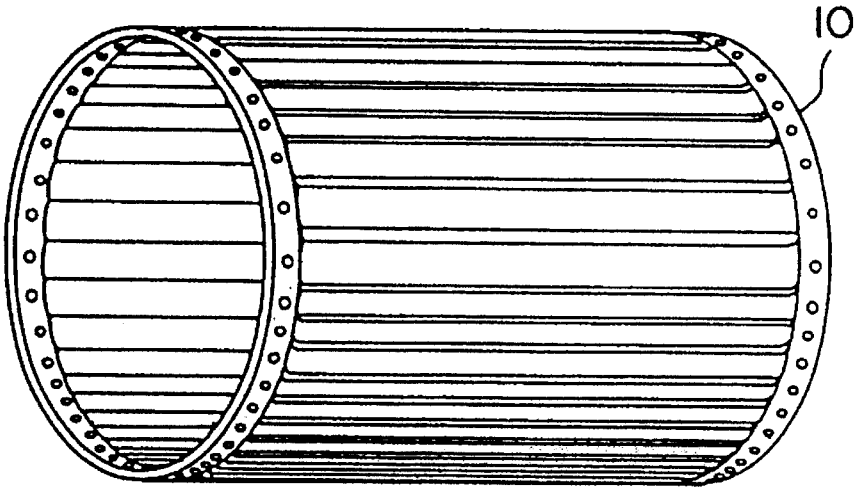
FIG. 9 is an inclined view of a cylindrical shell 10.
Figure 10:
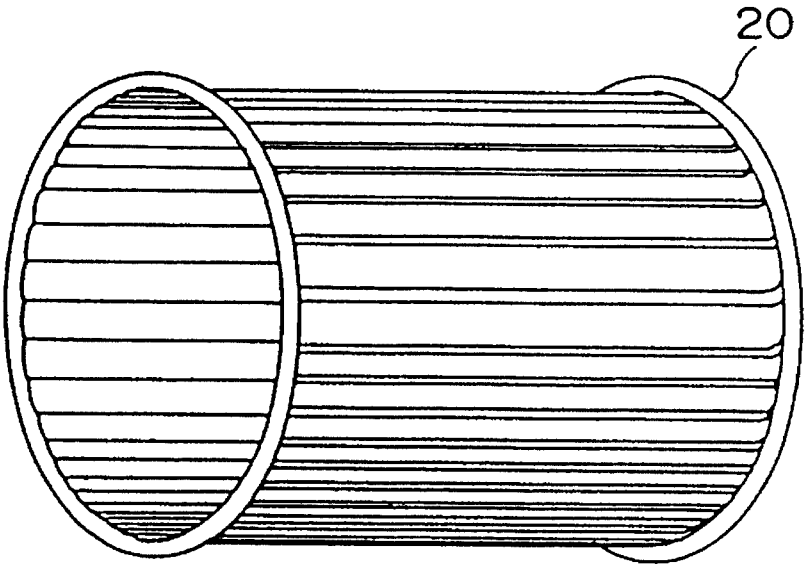
FIG. 10 is an inclined view of a cylindrical shell 20.
Figure 11:
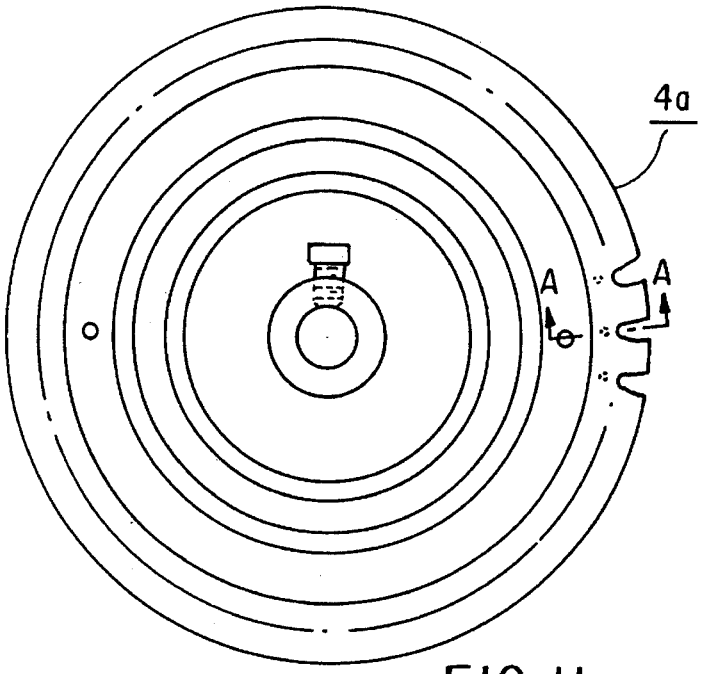
FIG. 11 is a schematic view of a center disk 4*a*.
Figure 13:
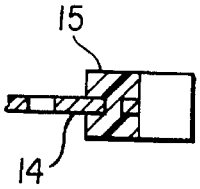
FIG. 13 is a cross-sectional view of the disk 4*a* shown along line A—A as illustrated in FIG. 11.
Figure 14:
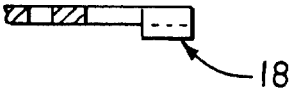
FIG. 14 is a cross-sectional view of the disk 4*b* shown along line B—B as illustrated in FIG. 12.

A preferred embodiment of this invention will now be described with reference to FIGS. 1–12. This embodiment will be described insofar as regards the improvement it makes to the blower wheel of a double inlet used in a ceiling installation type air ventilator. Conventionally, a type A wheel was used (diameter 284 mm, width 240 mm, 48 vane, vane arc length 29.0 mm, zinc plated steel plate construction, plate thickness 0.8 mm), however greater lightweightness (from 2.8 kg to 2.1 kg) and quieter operation (from 56 db to 53 db) was desired. If a type B wheel was used instead, the weight was reduced, but the desired air volume and pressure could not be obtained. In the case of a type C wheel, the desired air volume and pressure can be obtained and operation is quieter.

However, as an auxiliary heater is installed in the vicinity of the wheel, the type C wheel is deformed by heat which leads to fracture, consequently this type of wheel cannot be used.

1. The design procedure of this invention will now be described.

(1) The basic specification of a conventional wheel (diameter 284 mm, width 240 mm, 48 blades, blade arc length 29 mm) is used.

(2) Type B is chosen for the basic structure of the rotor.

(3) The arc length of the vane attachment member 5 is 18.6 mm, which is obtained by dividing the outer circumference of the wheel (892.8 mm) by the number of blades.

(4) Beads 7 are provided on the vane attachment members 5 parallel to the width direction of the blades in order to increase rigidity.

(5) Small holes 8 are provided on the vane attachment members 5 to improve the joints with the vane members 6.

(6) An injection molded plastic (petroleum synthetic resin) material having an airfoil shape of arc length 29 mm is used for the vane members 6.

(7) 48 blade attachment members 5 and end rings 1, 2 are fashioned from a single metal steel plate, and the left and right ends of the vane attachment members are joined to the end rings.

(8) A zinc-plated steel sheet of thickness 0.4 mm is used for the vane attachment members 5 and end rings 1, 2.

(9) The center disk 4*a* comprises a zinc-plated steel base plate, and 48 plastic receptacles 15.

(10) The center disk 4*a* is inserted into a cylindrical shell 20. 48 blades 3 provided on the cylindrical shell 20 are inserted into the 48 receptacles 15, and are fixed by means of adhesive or welding at predetermined positions.

Figure 12:
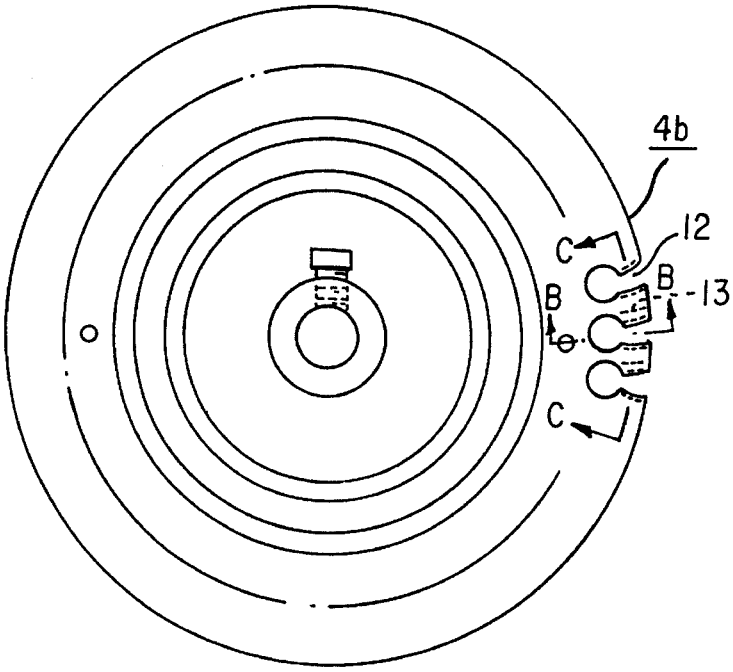
FIG. 12 is a schematic view of a center disk 4*b*.
Figure 15:
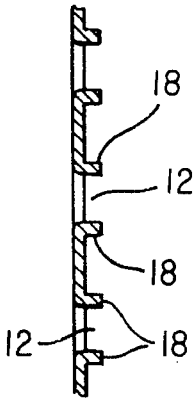
FIG. 15 is a cross-sectional view of the disk 4*b* shown along line C—C as illustrated in FIG. 12.

(11) An alternative design to the center disk 4*a* is a center disk 4*b* having press-stamped grooves 12 formed in the outer circumference of the disk base plate as shown in FIG. 12. The grooves 12 have a pair of walls 18 that face each other and are used to secure the blades 3 in the grooves 12. More specifically, an intermediate part 13 of the disk 4*b* between the grooves 12 is struck after the blades have been inserted into the grooves, so as to narrow the grooves 12 and firmly secure the blades 3 by the pair of walls 18.

2. Next, the manufacturing procedure according to this invention will be described.

(1) In progressive press-working, the zinc-plated steel plate (plate thickness 0.4 mm, plate width 260 mm, coil) is fashioned so as to form the vane attachment members 5 at equidistant intervals (18.6 mm), and the members 5 are reinforced by beads (width 2 mm, height 1.5 mm) parallel to the blade width direction. The small holes 8 for fixing vane members 6 of diameter approx. 2–5 mm are also pierced in the vane attachment members 5, one hole at each of the left and right ends, and at several positions towards the center. Feed cross-pieces for progressive press-working and pilot holes 11 in the crosspieces are left as they are in order to serve for positioning in the subsequent injection molding process and assembly process.

(2) This continuous strip is then cut to a length of 892.6 mm so as to obtain a stamped sheet 9.

(3) The vane members 6 are then molded of a heat-resistant plastic material by injection molding, and attached to the vane attachment members 5 so as cover them and form the blades 3. In the small holes 8, the injected resins fuse together to form one piece. This resolves problems of peeling between the metal vane attachment members 5 and the vane members 6 which are made of resin.

(4) A continuous blade plate 16 provided with 48 blades (FIG. 8) is then rolled into a cylinder, and its two ends 17*a* and 17*b* are brought together and welded by plasma welding or the like so as to obtain the cylindrical shell 10.

(5) Next, the two ends of the shell are curled over to obtain a cylindrical shell 20 with increased rigidity.

(6) The center disk 4*a* is then inserted in the cylindrical shell 20 so that the vane members 6 slide into the slits, and the vane members 6 are fixed. This completes the assembly of the wheel.

(7) The wheel may be formed also by inserting the disk 5*b* instead of the disk 5*a*, and the intermediate parts 13 situated effectively between the grooves 12 sharply struck so as to fix the vane members 6 and center disk 4*b* by caulking. The wheel obtained by this process was only 2.0 kg in the weight, and operating noise reached the desired level of 52.5 db Embodiment 2

When corrosive gases are present as in the case of a ventilator or exhaust device installed in a chemical plant aluminum alloy plate or stainless steel plate is used.

Embodiment 3

When high temperature gases are present, a ceramic material is used for the vane members.

As a result of the greater freedom of design according to this invention, optimum materials and shapes may be chosen depending on the operating conditions of the blower. Together with the advantages obtained by the manufacturing technique according to this invention,a 25% weight reduction and a 6% noise reduction were achieved. These advantages are moreover enhanced the larger the diameter of the wheel.

What is claimed:

1. A double inlet type centrifugal blower wheel with forward-curved multi-blades comprising:

a pair of end rings; a plurality of blades; and a center disk; wherein said blades comprise metal vane attachment members and non-metal vane members which fit over said vane attachment members, left and right sides of said vane attachment members are connected to said end rings, said vane attachment members and end rings are fashioned from a single continuous metal sheet, and said center disk is fixed to said blades; and wherein said center disk is formed from a metal disk base plate and non-metal blade receptacles fixed to said base plate, said blade receptacles and said vane members being fixed together.

2. A double inlet type centrifugal blower wheel with forward-curved multi-blades comprising:

a pair of end rings; a plurality of blades; and a center disk; wherein said blades comprise metal vane attachment members and non-metal vane members which fit over said vane attachment members, left and right sides of said vane attachment members are connected to said end rings, said vane attachment members and end rings are fashioned from a single continuous metal sheet, and said center disk is fixed to said blades; wherein said vane attachment members are provided with beads; and wherein said center disk is formed from a metal disk base plate and non-metal blade receptacles fixed to said base plate, said blade receptacles and said vane members being fixed together.

3. A double inlet type centrifugal blower wheel with forward-curved multi-blades comprising:

pair of end rings; a plurality of blades; and a center disk; wherein said blades comprise metal vane attachment members and non-metal vane members which fit over said vane attachment members, left and right sides of said vane attachment members are connected to said end rings, said vane attachment members and end rings are fashioned from a single continuous metal sheet, and said center disk is fixed to said blades; wherein said vane attachment members are provided with small holes; and wherein said center disk is formed from a metal disk base plate and non-metal blade receptacles fixed to said base plate, said blade receptacles and said vane members being fixed together.

4. A double inlet type centrifugal blower wheel with forward-curved multi-blades comprising:

a pair of end rings; a plurality of blades; and a center disk wherein said blades comprise metal vane attachment members and non-metal vane members which fit over said vane attachment members, said vane attachment members are formed from a single continuous metal sheet, said pair of end rings are manufactured from two metal sheets, and said center disk is fixed to said blades; and wherein said center disk is formed from a metal disk base plate and non-metal blade receptacles fixed to said base plate, said blade receptacles and said vane members being fixed together.

5. A double inlet type centrifugal blower wheel with forward-curved multi-blades comprising:

a pair of end rings; a plurality of blades; and a center disk; wherein said blades comprise metal vane attachment members and non-metal vane members which fit over said vane attachment members, said vane attachment members are formed from a single continuous metal sheet, said pair of end rings are manufactured from two metal sheets, and said center disk is fixed to said blades; wherein said vane attachment members are provided with beads; and wherein said center disk is formed from a metal disk base plate and non-metal blade receptacles fixed to said base plate, said blade receptacles and said vane members being fixed together.

6. A double inlet type centrifugal blower wheel with forward-curved multi-blades comprising:

a pair of end rings; a plurality of blades; and a center disk; wherein said blades comprise metal vane attachment members and non-metal vane members which fit over said vane attachment members, said vane attachment members are formed from a single continuous metal sheet, said pair of end rings are manufactured from two metal sheets, and said center disk is fixed to said blades;

wherein said vane attachment members are provided with small holes; and wherein said center disk is formed from a metal disk base plate and non-metal blade receptacles fixed to said base plate, said blade receptacles and said vane members being fixed together.

* * * * *